US008079777B2

(12) United States Patent
Van Velsor

(10) Patent No.: US 8,079,777 B2
(45) Date of Patent: Dec. 20, 2011

(54) REFLECTOR APPARATUS, HEATING SYSTEM, KIT AND METHOD

(76) Inventor: Wesley Van Velsor, Charlestown, NH (US)

( * ) Notice: Subject to any disclaimer, the term of this patent is extended or adjusted under 35 U.S.C. 154(b) by 0 days.

(21) Appl. No.: 12/583,226

(22) Filed: Aug. 17, 2009

(65) Prior Publication Data

US 2009/0311046 A1 Dec. 17, 2009

Related U.S. Application Data

(63) Continuation of application No. 11/237,572, filed on Sep. 28, 2005, now Pat. No. 7,578,634.

(51) Int. Cl.
*E01C 23/14* (2006.01)

(52) U.S. Cl. ..... 404/95

(58) Field of Classification Search ..... 404/77, 404/79, 95

See application file for complete search history.

(56) References Cited

U.S. PATENT DOCUMENTS 3,055,280 A * 9/1962 Neville ..... 404/95
3,221,617 A * 12/1965 Quigg ..... 404/95
3,311,104 A * 3/1967 Wollner et al. ..... 126/92 R
3,882,956 A * 5/1975 Plegat ..... 180/89.14
3,964,183 A * 6/1976 Mouat ..... 37/197
4,335,975 A * 6/1982 Schoelkopf ..... 404/77
4,601,605 A * 7/1986 Damp et al. ..... 404/95
4,711,600 A * 12/1987 Yates ..... 404/95
4,749,303 A * 6/1988 Keizer et al. ..... 404/86
4,779,889 A * 10/1988 Morrison ..... 280/475
4,850,740 A * 7/1989 Wiley ..... 404/79
5,114,284 A * 5/1992 Keizer et al. ..... 404/95
5,148,799 A * 9/1992 St-Louis et al. ..... 126/271.2 A
5,188,481 A * 2/1993 O'Brien ..... 404/95
5,653,552 A * 8/1997 Wiley et al. ..... 404/77
6,551,017 B1 * 4/2003 Strassman ..... 404/77
6,998,010 B2 * 2/2006 Wiley ..... 156/309.6
7,037,036 B2 * 5/2006 Strassman ..... 404/95

* cited by examiner

*Primary Examiner* — Raymond Addie

(74) *Attorney, Agent, or Firm* — Michael J. Persson; Catherine E. Napjus; Lawson & Persson, PC

(57) ABSTRACT

A reflector apparatus including a mobile trailer and a heat reflector attached thereto such that terminal edges of wings of the reflector are disposed proximate to the surface of the heated asphalt and define a plane that is substantially parallel to a plane formed by the surface of the heated asphalt. A kit includes a heat reflector and a mechanism or device for removably attaching the heat reflector to a mobile trailer.

13 Claims, 5 Drawing Sheets

REFLECTOR APPARATUS, HEATING SYSTEM, KIT AND METHOD

CLAIM OF PRIORITY

This application is a continuation of application Ser. No. 11/237,572 now U.S. Pat. No. 7,578,634, filed on Sep. 28, 2005.

FIELD OF THE INVENTION

The present invention relates to the field of asphalt paving and, in particular, to a reflector apparatus, kit, and asphalt heating system for increasing the durability of asphalt paving joints.

BACKGROUND OF THE INVENTION

Over the past thirty-five years, asphalt has replaced concrete as the material of choice for paving roadways. Asphalt provides a smooth road surface that is easier to apply and easier to resurface than concrete. However, asphalt pavers generally cannot pave an entire road surface in a single pass and therefore joints must be formed between the previously placed asphalt and the newly placed asphalt being placed by the paver. It is at these joints that asphalt is most susceptible to failure as the "cold", previously placed, asphalt is not sufficiently heated by the hot asphalt from the paver to deform during compaction. This leads to confined compaction, in which the new "hot" asphalt is not compacted, but rather is pushed sideways, resulting in a joint having that is not sufficiently dense and homogenously bonded. These non-homogenous "cold joints" often will separate and create cracks, most usually in the center of two lane roads, which allows water to enter the pavement, migrate to the road base and, over a period of time, contribute substantially to base failure of the road.

To overcome this problem, the previously placed pavement joint, must be heated to approximately the same temperature as the new material that is being placed to provide the proper environment for thermal bonding. However, the chemical properties of asphalt make this a difficult task. First, asphalt is a petroleum-based product and has a tendency to burn if overheated. Second, the mass and thermal conductivity of asphalt necessitate heating the asphalt for a significant period of time to raise the temperature of the entire asphalt layer to the desired bonding temperature. The combination of these properties makes traditional heating by propane torch, either hand-held or paver-mounted, an ineffective and dangerous exercise.

When paver-mounted heaters are used to preheat the asphalt, the temperature of the burning propane raises the temperature of the top layer of asphalt to its burning temperature well before the remainder of the asphalt layer has reached its desired bonding temperature. Thus, to avoid igniting the top of the asphalt layer, the paver must move before the entire layer is sufficiently heated, bonding the new hot asphalt to "warm" asphalt. This increases the adhesion somewhat, but does not increase the density of the joint sufficiently to provide the durability obtained by of a true "hot joint". When hand held heaters are used, the heat to the pavement may be cycled to allow proper heating of the entire layer. However, the risk of fire increases with this approach, as the operator controls the exposure of the heater to the pavement. In addition, the use of hand held heaters requires additional manpower and slows the paving process.

In response to this problem, the inventor of the present invention developed the paving apparatus and method disclosed and claimed in U.S. Pat. No. 6,227,762, which is incorporated herein by reference. This patent describes and claims a method that includes the steps of placing a first layer of asphalt in a roadway and allowing the first layer of asphalt to cool to a temperature below a predetermined minimum bonding temperature. The surface of the joining area of the first layer is then preheated to a temperature above the minimum bonding temperature but below the ignition temperature of the asphalt. The remainder of the joining area of the first layer is then allowed to absorb the heat from the surface. After a predetermined period of time is allowed for absorption of heat, the surface of the joining area of the first layer of asphalt is again heated to a temperature below the ignition temperature of the asphalt and the second layer of asphalt is placed adjacent to the first layer such that a joint is formed between the first layer and the second layer. Extensive testing using this method has confirmed that it is extremely effective at achieving the desired result. This testing has also caused the inventor to improve upon the asphalt heating system for performing the method.

In U.S. Pat. No. 6,227,762, the preferred heating system included one twelve foot infrared heater attached to the side of the paver and a mobile pre-heater "train" composed of several twelve foot infrared joint heating units pulled by a motorized vehicle. It was noted that two to three pre-heater units were sufficient for most paving conditions, as this number of heaters was sufficient to raise the temperature of the surface of the joining area of the first layer, which is then preheated to a temperature above the minimum bonding temperature but below the ignition temperature of the asphalt. However, testing has shown that heating with two to three pre-heater units does not allow the heat from the surface to penetrate downward all the way to the base to produce a full hot joint. Consequently, a hot joint is formed along a layer proximate to the surface and a "warm" joint is formed at a layer adjacent to the base. Such a joint is still a significant improvement over the cold joints of prior methods, as the hot portion of the joint is at the surface, which is where most failures begin. Notwithstanding this fact, the best joint is a full hot joint and, therefore, there remained a need for a system that would produce a full hot joint.

In response to this need, the inventor experimented with a number of pre-heater and post-heater configurations to determine how to heat the asphalt such that heat penetrates fully from surface to base to produce a substantially full hot joint. Testing was conducted utilizing thermocouples embedded at different depths within the asphalt and with continual monitoring of the cycling of the heaters based upon the temperature sensors attached thereto. This testing resulted in the development of the reflector apparatus, kit, asphalt paving system and method of the present invention.

SUMMARY OF THE INVENTION

The reflector apparatus, kit, system and method of the present invention were developed in response to empirical data developed through the testing conducted by the inventor. In particular, it was found that the third pre-heater unit in a train of pre-heater units would provide heat to the joint less than 50% of the time and would be turned off more than 50% of the time by the temperature sensors mounted thereon. The pre-heater units are designed such that heat escapes from their sides when running and, therefore are not effective at preventing the loss of heat from the asphalt when they are not running. Accordingly, the inventor developed the reflector apparatus as a means for reflecting the heat from the asphalt back downward onto the asphalt and for preventing the loss of this heat while it is penetrating downward toward the base of the asphalt.

The reflector apparatus of the present invention is adapted to reflect heat back downward upon a surface of heated asphalt. In its most basic form, the reflector apparatus includes a mobile trailer having a frame, a front, a rear, a bottom, a top, a front trailer hitch coupler mounted to the front, and a rear trailer hitch coupler mounted to the rear. At least one heat reflector is attached to the bottom of the mobile trailer. The heat reflector is manufactured of a heat reflective material, is dimensioned to cover a substantial portion of the bottom of the mobile trailer, and includes a body and a pair of wings extending downward from the body and terminating at a pair of terminal edges. The heat reflector(s) is/are attached to the bottom of the mobile such that the terminal edges of the wings are disposed proximate to the surface of the heated asphalt and define a plane that is substantially parallel to a plane formed by the surface of the heated asphalt.

In the preferred embodiment, the reflector apparatus is manufactured of aluminum and is removably attached to the bottom of the mobile trailer. The preferred reflector apparatus also includes a mechanism or device, such as jacks, for adjusting a distance between the pair of terminal edges of the heat reflector and the surface of the heated asphalt. The wings of the preferred heat reflector are each disposed at an angle of between 30° and 60° relative to the body of the heat reflector.

The preferred mobile trailer includes a pair of central wheels attached to the bottom of the mobile trailer and disposed substantially centrally between the front and the rear thereof, a pair of front caster wheels disposed proximate to the front of the mobile trailer and a pair of rear caster wheels disposed proximate to the rear of the mobile trailer. In the preferred mobile trailer, the weight of the mobile trailer is distributed substantially evenly between a front portion of the trailer in front of the drive wheels and a rear portion of the trailer behind the drive wheels and-the front caster wheel and the rear caster wheel are dimensioned and disposed such that the front and rear caster wheels do not contact the surface of heated asphalt when the surface of heated asphalt is substantially level. In the preferred reflector apparatus, the rear trailer hitch coupler is a hitch ball.

Some embodiments of the reflector apparatus include an infrared chamber attached to the bottom of the mobile trailer and a control box in electrical communication with the infrared chamber and including controls for controlling a flow of fuel to the infrared chamber. In such embodiments, the heat reflector is removably attached to the bottom surface of the infrared chamber to allow the reflector apparatus to serve both as a reflector apparatus and, alternatively, as a heater apparatus. In such embodiments, it is preferred that a plurality of C-shaped straps, wherein the plurality of C-shaped straps extend from the terminal edges of the heat reflector to the top surface of the infrared chamber to removably attach the heat reflector to the bottom surface of the infrared chamber.

In its most basic form, the heat reflector kit includes at least one heat reflector, such as those described above in connection with the reflector apparatus, for attachment to the bottom of the mobile trailer, and a mechanism or device for removably attaching the at least one heat reflector to the bottom of the mobile trailer. The heat reflector is manufactured of a heat reflective material, is dimensioned to cover a substantial portion of the bottom of the mobile trailer, and includes a body and a pair of wings extending downward from the body and terminating at a pair of terminal edges. The heat reflector is removably attached to the bottom of the mobile trailer such that the terminal edges of the wings are disposed proximate to the surface of the heated asphalt and define a plane that is substantially parallel to a plane formed by the surface of the heated asphalt.

In its most basic form, the heater system includes a plurality of heaters and at least one reflector apparatus. The heaters each include a mobile heater trailer comprising a frame having a front, a rear, a bottom and a top. A front trailer hitch coupler is mounted to the front and a rear trailer hitch coupler is mounted to the rear, each of which are dimensioned such that the front trailer hitch coupler of one pre-heater is dimensioned to mate with the rear trailer hitch coupler of another heater. An infrared chamber is attached to the mobile heater trailer for generating heat. A source of fuel is in communication with the infrared chamber, and a control box is in electrical communication with the infrared chamber. The control box comprises controls for controlling the flow of fuel from the source of fuel to the infrared chamber. Each reflector apparatus is substantially as described above. The heaters and reflector apparatus are arranged such that the front trailer hitch coupler of one of the plurality of heaters is attached to the rear trailer hitch coupler of the vehicle, the front trailer hitch coupler of a first of the at least one reflector apparatus is attached to one of the heaters and the rear trailer hitch coupler of the first reflector apparatus is attached to the front trailer hitch coupler of another of the plurality of heaters.

The preferred system utilizes six pre-heaters and two reflector apparatus. In this system, the front trailer hitch coupler of the first heater is attached to the rear trailer hitch coupler of the vehicle, the front trailer hitch coupler of the second heater is attached to the rear trailer hitch coupler of the first heater, a front trailer hitch coupler of the first reflector apparatus is attached to the rear trailer hitch coupler of the second heater, a front trailer hitch coupler of a third heater is attached to a rear trailer hitch coupler of the first reflector apparatus, the front trailer hitch coupler of the fourth heater is attached to the rear trailer hitch coupler of the third pre-heater, the front trailer hitch coupler of the second reflector apparatus is attached to the rear trailer hitch coupler of the fourth pre-heater, the front trailer hitch coupler of the fifth pre-heater is attached to the rear trailer hitch coupler of the second reflector apparatus, and the front trailer hitch coupler of the sixth pre-heater is attached to the rear trailer hitch coupler of the fifth pre-heater. It is preferred that the width of the mobile heater trailer is substantially equal to a width of the mobile reflector trailer.

The invention also includes a method of joining a new layer of asphalt to a previously laid layer of asphalt. The method includes the steps of preheating a surface of a joining area of the previously laid layer of asphalt to a temperature between a predetermined minimum bonding temperature and a predetermined danger temperature, the danger temperature being below an ignition temperature of the asphalt. Then placing the new layer of asphalt adjacent to the previously laid layer of asphalt such that a joint is formed between the new layer of asphalt and the previously laid layer of asphalt. Then cooling the new layer of asphalt and the joint to a temperature sufficient to allow the new layer of asphalt and the joint to be rolled. Then breakdown rolling the new layer of asphalt and the joint. Then post-heating the new layer of asphalt and the joint to a temperature between the predetermined minimum bonding temperature and the predetermined danger temperature. Then re-cooling the new layer of asphalt and the joint to a temperature sufficient to allow the new layer of asphalt and the joint to be rolled. Finally, finish rolling the new layer of asphalt and the joint.

Therefore, it is an aspect of the invention to provide a system by which asphalt pavement can be placed in such a way that cold joints can be avoided.

It is a further aspect of the invention to provide a system to heat pavement joints at the time of placing adjacent and abutting sections of pavement.

It is a further aspect of the invention to provide a heating system that will penetrate to a depth sufficient to achieve proper and permanent bonding to an adjacent course of asphalt pavement.

It is a further aspect of the invention to provide a heating system for heating cold joints that will not burn or damage the asphalt pavement.

It is a further aspect of the invention to provide a heating system, which will supply adequate heat penetration to increase compaction at the joint.

It is a further aspect of the invention to provide a system that will heat properly at any paving speed.

It is a further aspect of the invention to provide a joint heater that will be automatically controlled to eliminate human error and not be a burden to the paver operator.

It is a further aspect of the invention to provide a system that is fuel-efficient.

It is a further aspect of the invention to provide a system that is easy to work on with little maintenance involved.

It is a still further aspect of the invention to provide pre-heater units that are easy to transport from job to job.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE DRAWINGS

Figure 1A:
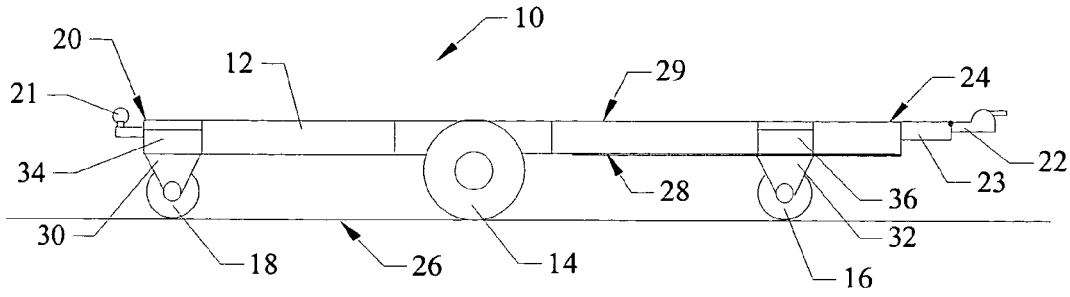
FIG. 1A is a side view of the preferred mobile trailer of the reflector apparatus of the present invention.
Figure 1B:
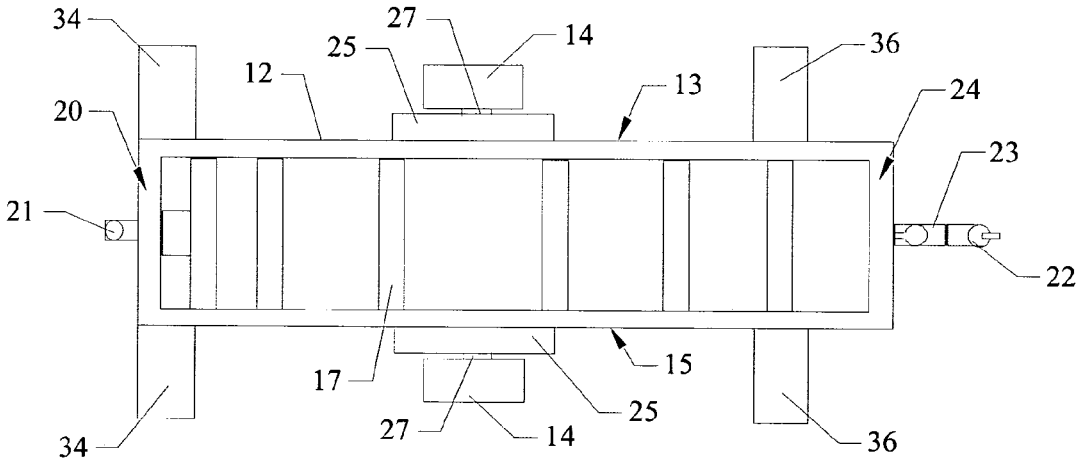
FIG. 1B is a top view of the mobile trailer of the reflector apparatus of FIG. 1A.

Referring first to FIGS. 1A and 1B, the preferred mobile trailer 10 of the reflector apparatus and system of the present invention is shown. The mobile trailer 10 includes a frame 12 to which is attached a pair of central wheels 14 and two sets of caster wheels 16, 18 at the front 24 and in the rear 20 of the frame 12, respectively. It is preferred that wheels 14, 16, 18 each be resistant to at least 275° F. to prevent degradation due to normal use of the mobile trailer 10. The pair of central wheels 14 and caster wheels 16, 18 are dimensioned such that the caster wheels 16, 18 do not come into contact with the surface 26 of the pavement when the weight of the trailer 10 is evenly balanced, but also such that the bottom surface 28 of the frame 12 remains substantially perpendicular to the surface 26 of the pavement when either caster wheels 16 or caster wheels 18 are in contact with the surface 26 of the pavement. Central wheels 14 are each attached to axel mounts 25, which are welded to the sides 13, 15 of the frame 12, and from which central axles 27 extend. Caster wheels 16, 18 attach to the frame 12 via caster axles 30, 32, which are rotatably attached to caster extensions 34, 36 that extend outward from the sides 13, 15 of the frame 12 of the mobile trailer 10. The use of caster extensions 34, 36 is preferred, as this allows the usable width of the bottom of the frame 12 to be larger than could be achieved were the caster wheels 16, 18 attached directly to the sides of the frame 12.

The use of the caster wheels 16, 18 and central wheels 14 are an improvement over the mobile trailer of the pre-heater described in the inventor's prior patent, insofar as this arrangement allows the mobile trailer 10 to more closely track the movement of the tractor (not shown) than could be achieved using the mobile trailers of the pre-heater disclosed and claimed in U.S. Pat. No. 6,227,762. Accordingly, the mobile trailer 10 described in FIGS. 1A and 1B is preferred. However, the mobile trailer described in connection with the pre-heater of the inventor's prior patent, or any other mobile trailer having a frame and at least one pair of wheels, may be substituted to achieve similar results.

A rear trailer hitch coupler, here hitch ball 21, is disposed at the rear 20 of the frame 12, and a front trailer hitch coupler 22 is disposed at the front 24 of the frame 12. The preferred front trailer hitch coupler 22 preferably attaches to a coupler extension 23, which is rotatably attached to the front 24 of the frame 12 such that the trailer hitch coupler extension 23 extends horizontally when in use and may be rotated to extend vertically during storage. The trailer hitch coupler extension 23 further includes a recessed portion dimensioned to accept the front trailer hitch coupler 22 when the front trailer hitch coupler 22 is rotated 180° toward the front 24 of the frame 12. The use of a rotatable front trailer hitch coupler 22 and coupler extension 23 is preferred as such a front trailer hitch coupler 22 and coupler extension 23 allow the overall length of the mobile trailer 10 to be reduced during storage. However, any art recognized trailer hitch coupler, with or without coupler extension 23, could be substituted to achieve similar results.

The frame 12 of mobile trailer 10 is preferably rectangular in shape and includes a plurality of cross braces 17 disposed across the width of the frame 12. The frame 12 is preferably manufactured of steel, as steel is readily available, provides adequate strength, is relatively inexpensive, and is easily manufactured using standard welding equipment. However frames made of other materials, such as aluminum, may be substituted in instances where less weight is desired.

Figure 2A:
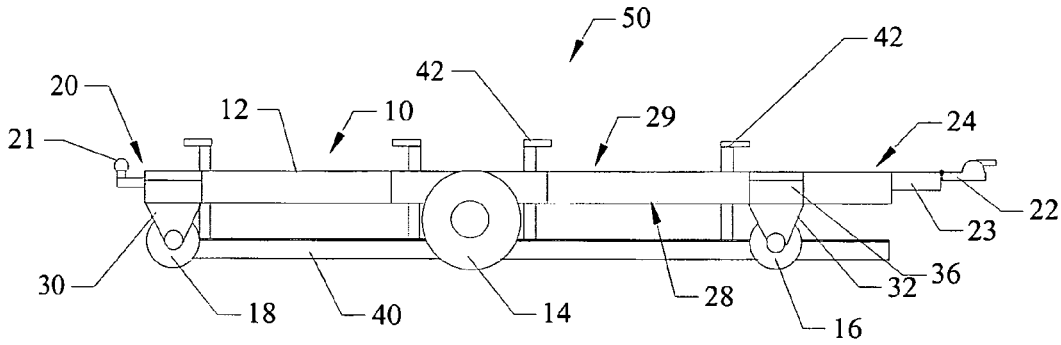
FIG. 2A is a side view of the preferred reflector apparatus of the present invention.
Figure 2B:
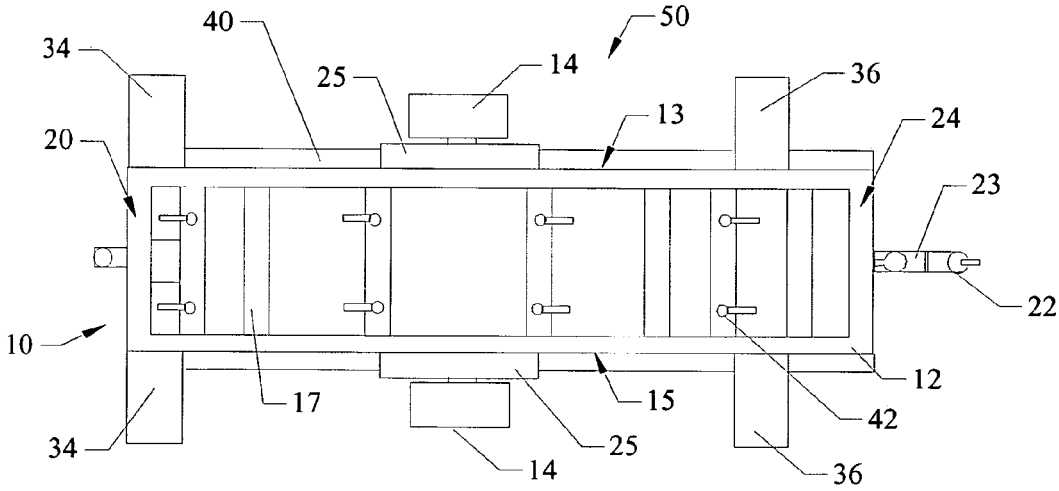
FIG. 2B is a top view of the reflector apparatus of FIG. 2A.
Figure 3A:
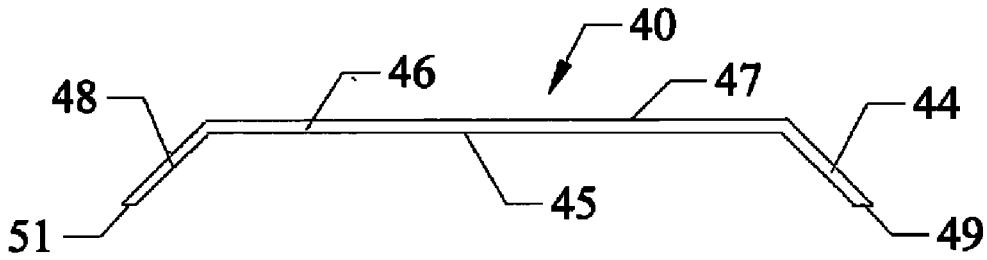
FIG. 3A is a side view of the preferred heat reflector of the present invention.
Figure 3B:
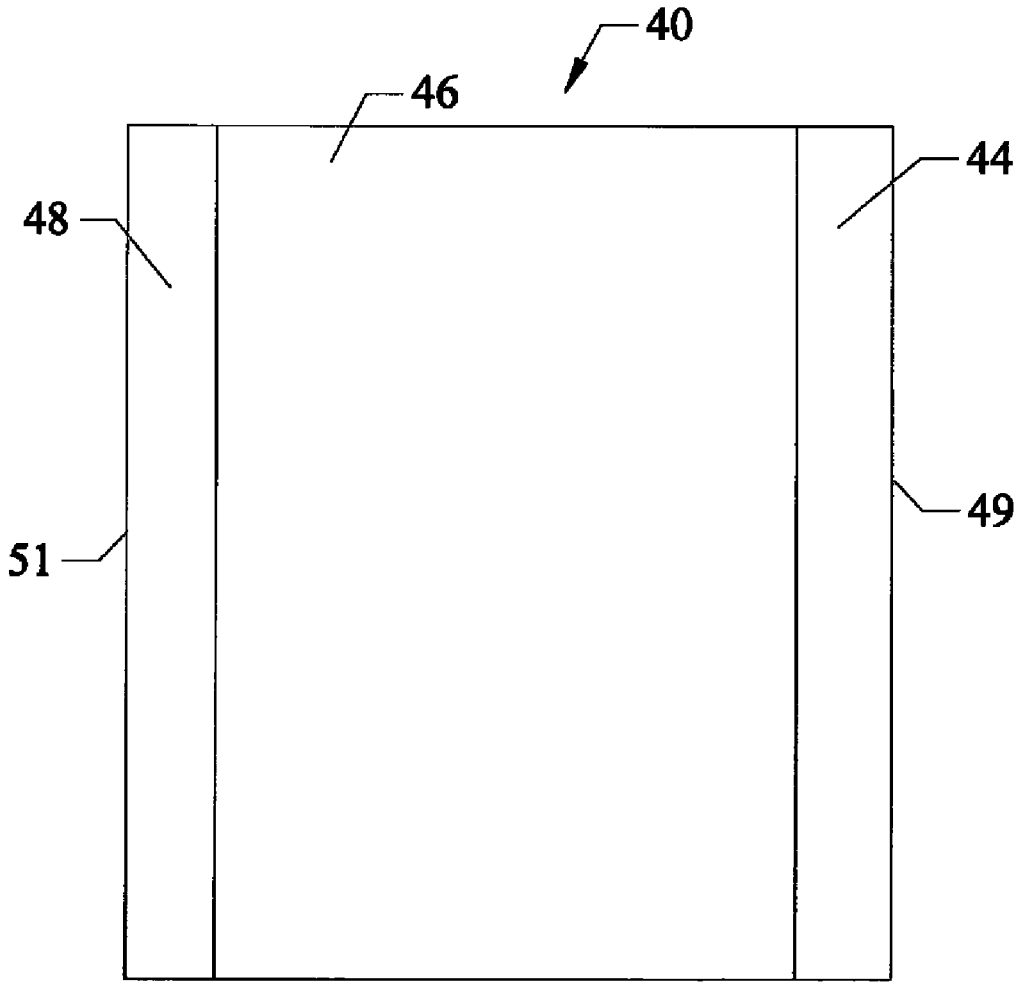
FIG. 3B is a top view of the preferred heat reflector of FIG. 3A.

Referring now to FIGS. 2A and 2B, a preferred embodiment of the reflector apparatus 50 of the present invention is shown. The reflector apparatus 50 includes the mobile trailer 10 described in detail in connection with FIGS. 1A and 1B, to which heat reflector 40 is attached. As shown in FIGS. 3A and 3B, heat reflector 40 preferably includes a body 46 and a pair of wings 44, 48 that extend downward from the body 46 and terminate at a pair of terminal edges 49, 51. Heat reflector 40 includes a top surface 47, which faces the bottom 28 of frame 12, and a bottom surface 45, which faces the surface 26 of the asphalt. Wings 44, 48 each preferably extend in the direction of bottom surface 45 and outward from the body 46 at a 45° angle, but wings 44, 48 disposed at wider or narrower angles may be substituted to achieve similar results.

Heat reflector 40 is disposed between the bottom 28 of frame 12 and the asphalt surface 26. Heat reflector 40 is preferably dimensioned to cover a substantial portion of the frame 12 of the mobile trailer 10 and is manufactured of a material that is capable of withstanding temperatures in excess of 350° F. and is a good reflector of heat. The preferred heat reflector 40 is manufactured of 16 gauge aluminum sheet due to its light weight, temperature resistance, ability to absorb and reflect heat back downward into the surface 26 of the asphalt, and ease with which it is cleaned without the need for special surface treatments. However, it is recognized that other materials, such as steel painted with a reflective material, such as aluminum paint, stainless steel, or other commonly used sheet metals, may be substituted to achieve similar results.

In the preferred reflector apparatus 50, the heat reflector 40 is removably attached to the frame 12 of the mobile trailer 10 by a plurality of jacks 42, which allow the distance between the terminal edges 49, 51 of the heat reflector 40 and the asphalt surface 26 to be adjusted. The jacks 42 shown in FIGS. 2A and 2B are simple screw type jacks, such as those commonly used on boat and snowmobile trailers. In this embodiment, each jack 42 operates independently from the other jacks 42, which requires each jack 42 to be progressively adjusted. However, in other embodiments, such as those in which the jacks 42 all are hydraulic jacks, or in those embodiments in which the jacks 42 are operated by electrical motors (not shown), all of the jacks 42, or groups of jacks 42, may be adjusted at the same time. Further, such adjustment may be controlled via a manual remote control, or may be automatically controlled based upon input obtained from temperature sensors mounted to the reflector apparatus 50 and/or the pre-heater units 70 discussed below. In still other embodiments, jacks 42 are replaced by other art recognized means for adjusting a distance between the pair of terminal edges 49, 51 of the heat reflector 40 and the surface 26 of the heated asphalt, such as cable and pulley systems, pin and clevis systems, or the like, to achieve similar results.

Figure 4:
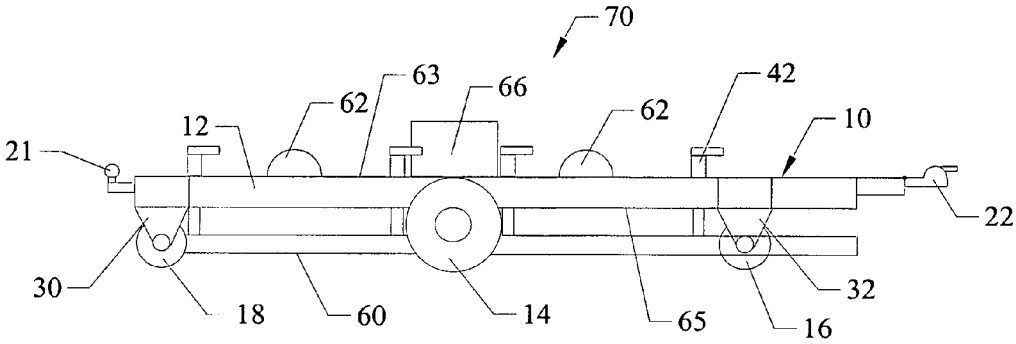
FIG. 4 is a side view of a pre-heater of the system of the present invention

The system of the present invention includes a plurality of pre-heater units 70, such as those shown in FIG. 4 herein, or those disclosed and claimed in U.S. Pat. No. 6,227,762, and at least one reflector apparatus 50. As shown in FIG. 4, the pre-heater unit 70 includes a mobile trailer 10, such as the mobile trailer 10 described above with reference to FIGS. 1A and 1B, an infrared chamber 60, a pair of a propane tanks 62, and a control box 66, which controls the supply of propane from the propane tanks 62 to the infrared chambers 60.

Infrared chambers 60 are attached to the frame 12 of mobile trailer 10 via a plurality of jacks 42 in a manner similar to that described above with regard to the attachment of heat reflector 40 to the frame 12 in the embodiment of FIGS. 2A and 2B. Infrared chamber 60 preferably contains four infrared energy converters, such as those manufactured by Ray-Tech Infrared Corporation of Charlestown, N.H. The infrared chamber 60 preferably operates in a manner typical of conventional infrared chambers, insofar as it burns propane within each infrared energy converter, which then radiates energy downward toward the pavement.

The control box 66 is similar in all respects to the control box and control system disclosed and claimed in U.S. Pat. No. 6,227,762, and contains all necessary controls, valves, blowers, switches, sensors and the like to control and operate the infrared chamber 60. An electronic igniter (not shown) is controlled by the control box 66 based upon signals from a sensor system (not shown), which sends a signal to the control box 66 when a predetermined condition is met. In some embodiments, this sensor is a wheel rotation sensor that senses the rotation of the central wheels 14 of the trailer and sends a signal to the control box 66 prompting the infrared chamber 60 to shut down when the wheels slow to a speed that will allow the asphalt to be heated above the danger level.

The preferred sensor system is an infrared heat sensing device that measures the temperature of the asphalt and an output for sending a signal to the control box 66. This infrared sensor system is preferably positioned in such a way as to permit the infrared sensor to "view" the pavement in the rear of the pre-heater 70. The information from the infrared sensor is analyzed by the control box 66 to determine if the temperature of the existing asphalt is above a predetermined danger level less than the ignition temperature of the asphalt, 325° Fahrenheit in the preferred embodiment. If the temperature is above this danger level, a signal is sent to the control box 66 to turn the heater off and/or to raise the level of the infrared chamber relative to the pavement. When the temperature drops below the minimum preferred bonding temperature, 275° Fahrenheit in the preferred embodiment, a signal is sent to the control box 66 to pressurize the manifold with gas and air and activate the electric igniter, turning the heater back on and/or lower the infrared chamber 60 back toward the pavement. It has been found that raising the level of the infrared chamber 60 relative to the pavement is preferable to the cycling the infrared chamber 60 on and off. This is due to the fact that the radiative heating of pavement by the infrared chamber 60 is greatly reduced when distance between the two is increased, reducing the chance that the asphalt will ignite, but the continued heat from infrared chamber 60 keeps the temperature at pavement level higher than at the base of the pavement, allowing the heat within the pavement to conduct downward into the pavement rather than conducting upward toward the surface. Accordingly, the base of the pavement may be more quickly heated when the infrared chambers 60 are kept running than when they cycled on and off.

The pre-heater 70 of FIG. 4 is an improvement over the pre-heaters disclosed and claimed in U.S. Pat. No. 6,227,762, in a number of ways. First, as explained above, the mobile trailer 10 of the improved pre-heater 70 more closely tracks the movement of the tractor (not shown) than could be achieved using the mobile trailers of the pre-heater disclosed and claimed in U.S. Pat. No. 6,227,762. Second, the propane tanks 62 of the improved pre-heater 70 are adapted to horizontally mount to the frame 12 of the mobile trailer, effectively reducing the height of the pre-heater 70 and making it possible to stack multiple pre-heaters 70 on top of each other during storage. Finally, mounting the control box 66 over the central wheels 14 better distributes the weight on the mobile trailer 10, making the pre-heater 70 more stable.

Figure 5:
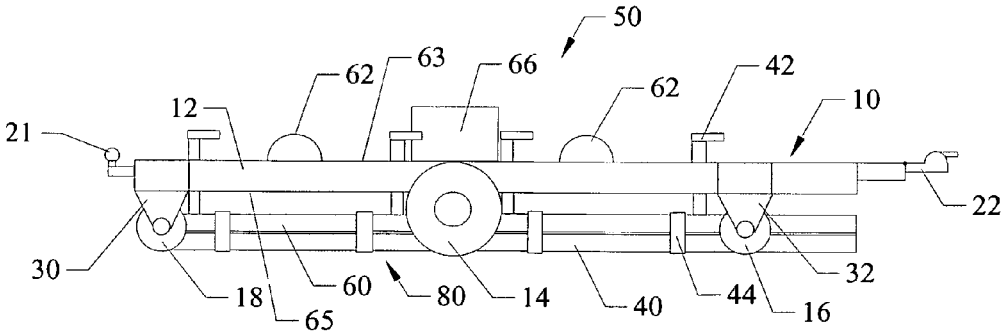
FIG. 5 is a side view of a pre-heater of the system of the present invention to which a reflector kit is attached to form a reflector apparatus of the present invention.

Referring now to FIG. 5, one embodiment of the reflector apparatus 50 is shown in which the heat reflector kit 80 of the present invention is attached to the infrared chamber 60 of the pre-heater 70 of FIG. 4.

The reflector kit 80 includes a heat reflector 40, such as the heat reflector 40 described above with reference to FIGS. 3A and 3B, and means for removably attaching the heat reflector 40 to the bottom of the frame 12 of the mobile trailer 10. In this embodiment, the heat reflector 40 is removably attached to the bottom surface 65 of the infrared chamber 60 by a plurality of C-shaped straps 44, which extend from the terminal edges 49, 51 of the heat reflector 40 to the top surface 63 of the infrared chamber 60. In the embodiment of FIG. 5, straps 44 are dimensioned such that they are slightly smaller than the combined width of the infrared chamber 60 and the heat reflector 40, such that straps 44 produce a compressive force that holds the heat reflector 40 in-place without the need for additional mechanical fasteners. However, in other embodiments the straps 44 may be fitted with set screws or other mechanical means for providing such a compressive force. In still other embodiments, straps 44 are eliminated completely, and other mechanical fasteners such as nuts and bolts, clips, or other art recognized fastening means are utilized to removably attach the heat reflector 40 to the infrared chamber 60.

Figure 6:
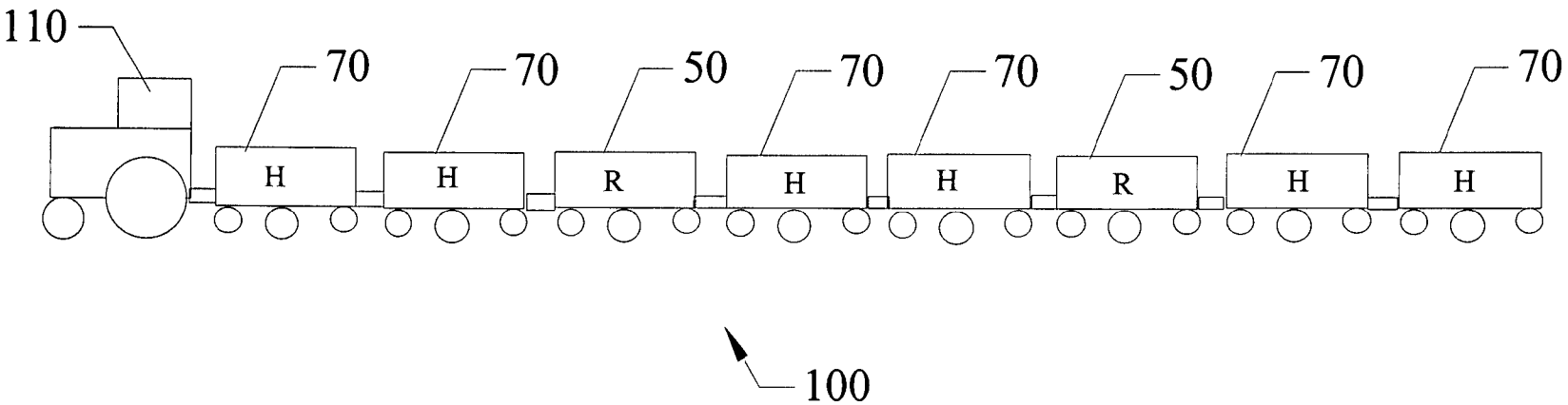
FIG. 6 is a diagrammatic view of one embodiment of the system of the present invention in which one reflector apparatus is disposed after every two pre-heater apparatus.

Referring now to FIG. 6, the preferred pre-heater system 100 of the present invention is shown. The preferred pre-heater system 100 includes a tractor 110 to which six pre-heaters 70 and two reflector apparatus 50 are attached. As noted above, it is preferred that the pre-heaters 70 and reflector apparatus 50 be arranged such that one reflector apparatus 50 follows the first set of two pre-heaters 70 and one reflector apparatus 50 follows the second set of two pre-heaters 70. A third reflector apparatus 50 may be included after the third set of two pre-heaters 70, although such a reflector apparatus 50 is not shown in FIG. 6.

The reflector apparatus 50 may take the form of the dedicated reflector apparatus 50 of FIGS. 2A and 2B, or may take the form of the pre-heater 70 with reflector kit 80 attached thereto of FIG. 5. The reflector kit 80 allows users of the system of the present invention to vary the arrangement of pre-heaters 70 and reflector apparatus 50 to meet their particular needs without the need to purchase separate reflector apparatus, which is advantageous to those users who have already purchased a plurality of pre-heaters 70 and do not wish to incur the additional costs involved in purchasing new reflector apparatus 50. However, as the dedicated reflector apparatus 50 of FIGS. 2A and 2B are significantly less expensive than the pre-heaters 70, it is recognized that first-time purchasers are more likely to purchase separate reflector apparatus 50, such as those described above with reference to FIGS. 2A and 2B rather than purchasing only pre-heaters 70 and reflector kits 80.

In operation, a first layer of asphalt is put down by the paver and is cools to a temperature below the desired temperature range for joining. The pre-heating system of the present invention is then utilized to heat the first layer in order to create the desired "hot" joint between the first and second layer of asphalt. Pre-heating is accomplished by disposing the pre-heater system a fixed distance in front of the paver and conveying the pre-heater at substantially the same speed as the paver. The first set of pre-heaters 70 of the system 100 heats the top surface 26 of the asphalt to a temperature between 275° F. and 325° F. The reflector apparatus 70 then passes over the preheated top surface 26, causing the heat radiating upward from the surface 26 to be reflected back downward towards the surface 26, preventing the majority of the heat from escaping upward and consequently causing the heat to penetrate downward into the asphalt. The penetration of the heat into the asphalt causes a reduction in temperature of the top surface 26 thereof. The second set of pre-heaters 70 then pass over the top surface 26, again raising the temperature to a temperature between 275° F. and 325° F. This is followed by the second reflector apparatus 50, which again causes a reflection of the majority of the heat downward into the asphalt. Finally, the final pair of pre-heaters 70 pass over the surface 26 of the asphalt, heating the asphalt to its final preheated temperature. By providing multiple heating and reflecting cycles, heat is allowed to penetrate fully through the layer of asphalt, resulting in a full hot joint when the paver lays a second layer of asphalt next to the first layer of asphalt that has been preheated. It is noted that this arrangement is preferred, but is not the only possible arrangement. Rather, the optimal arrangement of pre-heaters 70 and reflectors 50 is determined based upon the speed of the paver, the thickness of the pavement to be heated, the ambient temperatures, distances between the infrared chambers and the pavement, and other factors. Accordingly, the arrangement of the pre-heater system should not be seen as being limited to the arrangement set forth in FIG. 6.

In addition to preheating, testing has revealed that post-heating of the joint after the paver has laid it also results in an increase in joint density, and that this increase allows the density of the joint to approach one hundred percent (100%) of the density of the remainder of the asphalt surface. Accordingly, the methods described and claimed in claimed in U.S. Pat. No. 6,227,762 have been modified to include this step. Further, the inventor has found that the methods of present invention are readily adapted to the repair of existing asphalt joints and has developed the method described below for use in connection therewith.

When used in connection with newly laid pavement, the paving method includes the step of preheating a portion of a previously laid layer of asphalt to a temperature within a predetermined temperature range below the ignition temperature of the asphalt. This is preferably accomplished utilizing the heater system of present invention, described above, and results in substantially all of the edge of the previously laid layer of asphalt being heated to a temperature of within the desired temperature range for joining; between 275° Fahrenheit and 325° Fahrenheit in the preferred embodiment.

The next step is completed by the paver, which follows the pre-heater and performs the step of placing a new layer of asphalt adjacent to the previously laid layer. As noted below, the paver may take many forms, but in embodiments of the method used in connection with new pavement, the paver is preferably a conventional paver of sufficient width to pave more than one-half of a two-lane roadway.

The next step is to allow the newly laid pavement and heated joint to cool to a temperature that will allow the pavement to be rolled. This cooling step typically takes approximately 20 minutes under ambient temperatures of 70° Fahrenheit. The cooled pavement is then rolled using a breakdown roller to compact it.

The compacted joint is then post-heated to a temperature within a predetermined temperature range below the ignition temperature of the asphalt; again between 275° Fahrenheit and 325° Fahrenheit in the preferred embodiment, again allowed to cool, and then rolled using a finish roller. The post-heating step is preferably accomplished using an embodiment of the pre-heater system described above. Accordingly, where the term pre-heater apparatus or pre-heater system is used herein, it should be understood that such a system is equally applicable to post-heating and should not be so limited.

In embodiments of the method used in connection with the repair of existing pavement, the first step is to grind the joint area of the previously laid layer of asphalt to remove a substantial portion of the existing asphalt therefrom, forming a channel within the previously laid layer of asphalt. The area of the first layer of the asphalt around the channel is then preheated to a temperature within a predetermined temperature range below the ignition temperature of the asphalt; again between 275° Fahrenheit and 325° Fahrenheit in the preferred embodiment. A new layer of asphalt is then placed within the channel, allowed to cool, and breakdown rolled. Finally, the new layer of asphalt and the area adjacent to the new layer of asphalt are post-heated, allowed to cool, and finish rolled, effectively repairing the joint.

In the preferred embodiment of the method the grinding, preheating, paving and post-heating are each accomplished using specialized repair equipment. Such equipment is much narrower than the equipment utilized in connection with conventional paving operations and allows it to be easily transported to areas in need of repair. The equipment includes a grinder, pre-heater system including pre-heater apparatus and reflector apparatus, a mini-paver and a post-heater apparatus and/or system. This equipment is not currently available on the market and is likewise considered to be a part of the present invention. Further, it is noted that the repair method and equipment used therewith may not include the post heating steps and post-heaters. Thus, the repair system and method should not be seen as being so limited.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A reflector apparatus for reflecting heat back downward upon a surface of heated asphalt, said apparatus comprising:

a mobile trailer comprising a frame and having a front, a rear, a bottom, and a top; at least one heat reflector attached to said bottom of said mobile trailer, wherein said heat reflector is manufactured of a heat reflective material, is dimensioned to cover a substantial portion of said bottom of said mobile trailer, and comprises a flat, sheet-like body and a pair of wings extending downward from said body and terminating at a pair of terminal edges;

wherein said at least one heat reflector is attached to said bottom of said mobile trailer such that said terminal edges of said wings are disposed proximate to the surface of the heated asphalt and define a plane that is substantially parallel to a plane formed by the surface of the heated asphalt.

2. The reflector apparatus as claimed in claim 1 wherein said heat reflector is manufactured of aluminum and is removably attached to said bottom of said mobile trailer.

3. The reflector apparatus as claimed in claim 1 further comprising at least one means for adjusting a distance between said pair of terminal edges of said heat reflector and the surface of the heated asphalt.

4. The reflector apparatus as claimed in claim 1 wherein said mobile trailer further comprises a pair of central wheels attached to said bottom of said mobile trailer and disposed substantially centrally between said front and said rear thereof, a pair of front caster wheels disposed proximate to said front of said mobile trailer and a pair of rear caster wheels disposed proximate to said rear of said mobile trailer.

5. The reflector apparatus as claimed in claim 4 wherein a weight of said mobile trailer is distributed substantially evenly between a front portion of said trailer in front of said drive wheels and a rear portion of said trailer behind said drive wheels, and wherein said front caster wheel and said rear caster wheel are dimensioned and disposed such that said front and rear caster wheels do not contact the surface of heated asphalt when the surface of heated asphalt is substantially level.

6. The reflector apparatus as claimed in claim 1 further comprising a rear trailer hitch coupler mounted to said rear of said frame wherein said rear trailer hitch coupler comprises a hitch ball.

7. The reflector apparatus as claimed in claim 1 wherein said wings of said heat reflector are each disposed at an angle of between 30° and 60° relative to said body of said heat reflector.

8. A heat reflector kit for mounting on a mobile trailer comprising a frame having a front, a rear, a bottom and a top, to form a reflector apparatus for reflecting heat back downward upon a surface of heated asphalt, wherein said heat reflector kit comprises:

at least one heat reflector for attachment to said bottom of said mobile trailer, wherein said heat reflector is manufactured of a heat reflective material, is dimensioned to cover a substantial portion of said bottom of said mobile trailer, and comprises a flat, sheet-like body and a pair of wings extending downward from said body and terminating at a pair of terminal edges; and means for removably attaching said at least one heat reflector to the bottom of the mobile trailer such that said terminal edges of said wings are disposed proximate to the surface of the heated asphalt and define a plane that is substantially parallel to a plane formed by the surface of the heated asphalt.

9. The heat reflector kit as claimed in claim 8 wherein said heat reflector is manufactured of aluminum.

10. The heat reflector kit as claimed in claim 8 further comprising means for adjusting a distance between said pair of terminal edges of said heat reflector and the surface of the heated asphalt.

11. The heat reflector kit as claimed in claim 8 wherein each of said wings of said heat reflector are each disposed at an angle of between 30° and 60° relative to said body of said heat reflector.

12. A reflector apparatus for reflecting heat back downward upon a surface of heated asphalt, said apparatus comprising:

a mobile trailer comprising a frame and having a front, a rear, a bottom, and a top;

at least one heat reflector attached to said bottom of said mobile trailer:

wherein said heat reflector is manufactured of a heat reflective material, is dimensioned to cover a substantial portion of said bottom of said mobile trailer, and comprises a flat, sheet-like body and a pair of wings extending downward from said body and terminating at a pair of terminal edges; and wherein said at least one heat reflector is attached to said bottom of said mobile trailer such that said terminal edges of said wings are disposed proximate to the surface of the heated asphalt and define a plane that is substantially parallel to a plane formed by the surface of the heated asphalt;

an infrared chamber attached to said bottom of said mobile trailer, said infrared chamber having a bottom surface and shaped as a flattened rectangular prism, dimensioned to cover a substantial portion of said bottom of said mobile trailer, wherein said at least one heat reflector is removably attached to said bottom surface of said infrared chamber; and a control box in electrical communication with said infrared chamber, said control box comprising controls for controlling a flow of fuel to said infrared chamber.

13. The reflector apparatus as claimed in claim 12 further comprising a plurality of C-shaped straps, wherein said plurality of C-shaped straps are dimensioned to extend from the terminal edges of the heat reflector to the top surface of the infrared chamber to removably attach said heat reflector to said bottom surface of said infrared chamber.

* * * * *